US008015935B2

(12) United States Patent
Gai et al.

(10) Patent No.: US 8,015,935 B2
(45) Date of Patent: Sep. 13, 2011

(54) WATERCRAFT CONTROL APPARATUS

(75) Inventors: Giorgio Gai, Genoa (IT); Alessandro Staiolo, Ronco Scrivia (IT); Giorgio Bosia, Genoa (IT)

(73) Assignee: Ultraflex S.p.A., Casella (IT)

( * ) Notice: Subject to any disclaimer, the term of this patent is extended or adjusted under 35 U.S.C. 154(b) by 67 days.

(21) Appl. No.: 11/838,886

(22) Filed: Aug. 15, 2007

(65) Prior Publication Data

US 2008/0041288 A1 Feb. 21, 2008

(30) Foreign Application Priority Data

Aug. 16, 2006 (IT) ..... SV2006A0024

(51) Int. Cl.
*B63H 25/00* (2006.01)
*B63H 25/02* (2006.01)
*B63H 25/10* (2006.01)
*B63H 25/12* (2006.01)

(52) U.S. Cl. ..... 114/144 R; 114/144 RE; 114/150

(58) Field of Classification Search ..... 114/144 R, 114/150, 144 RE, 144 A; 440/53, 61 R, 61 C; 74/480 B; 701/21
See application file for complete search history.

(56) References Cited

U.S. PATENT DOCUMENTS 4,550,597 A * 11/1985 Drutchas et al. ..... 73/117.02
5,146,745 A * 9/1992 Doetsch ..... 60/403
5,248,939 A * 9/1993 Brauer ..... 324/174
6,273,771 B1 * 8/2001 Buckley et al. ..... 440/84
6,564,739 B2 * 5/2003 Doetsch ..... 114/150
7,465,202 B2 * 12/2008 Takada et al. ..... 440/61 S

* cited by examiner

*Primary Examiner* — Ajay Vasudeva
(74) *Attorney, Agent, or Firm* — Themis Law

(57) ABSTRACT

In one embodiment, a watercraft control apparatus according to the present invention includes a control member that operates a power-consuming unit or load. The control member is operably connected to the power-consuming unit or load through a drive member that transmits a control force and/or a displacement from the control member to the power-consuming unit or load. The watercraft control apparatus further includes an actuator for actuating the power-consuming unit and a magnetic unit for transducing the force and/or the displacement of the control member into a corresponding electric/electronic signal for a corresponding operation of the actuator.

37 Claims, 5 Drawing Sheets

FIG. 4A
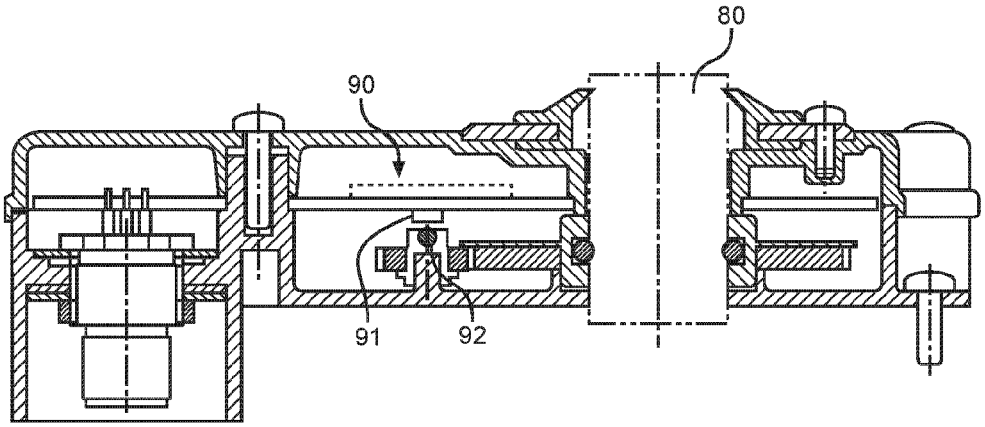
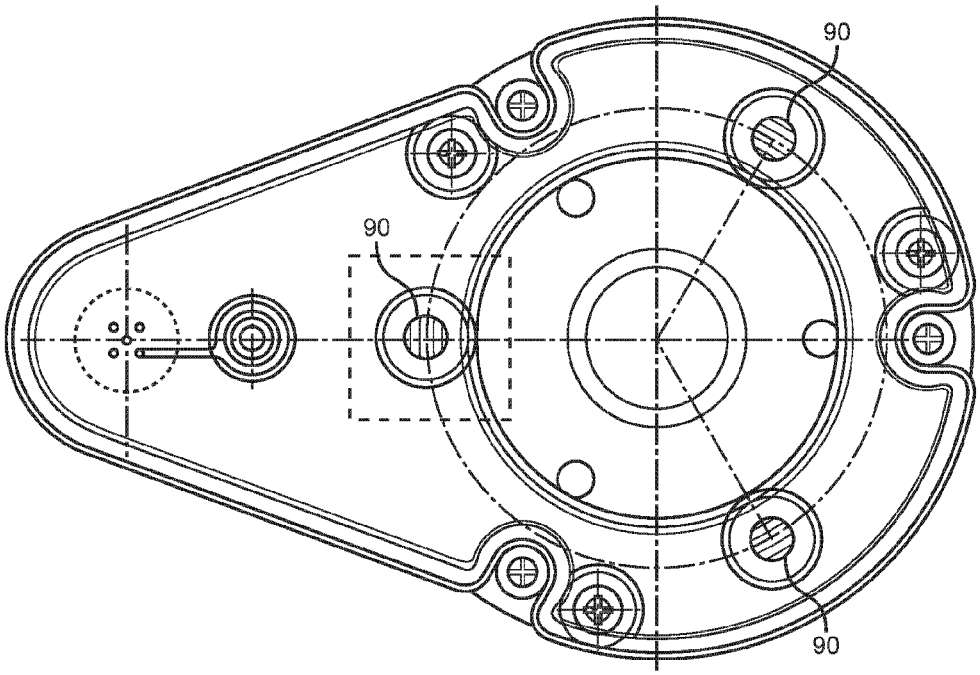
FIG. 4

WATERCRAFT CONTROL APPARATUS

FIELD OF THE INVENTION

The present invention relates to an apparatus for controlling a watercraft and other transport vehicles. More particularly, the present invention relates to a watercraft control apparatus that includes a control member for operating a power-consuming unit or load through one or more magnetic units.

BACKGROUND OF THE INVENTION

Apparatus for controlling watercraft and similar transport vehicles are known in the art. Known watercraft control apparatus, however, suffer from certain drawbacks.

In particular, watercraft control apparatus of the prior art include a first transmission line for mechanical control signals that receives mechanical control signals from a mechanical control signal input unit, such as a rudder wheel, a steering wheel, a control lever or the like. For example, a first mechanical control signal transmission circuit or line may mechanically connect a rudder wheel, a steering wheel, a control lever or a similar device to a power-consuming unit, such as a rudder, a motor or a similar device.

A second transmission line for electric or electronic control signals may also be included in watercraft control apparatus of the prior art to provide a power-assisted mechanical control. Such second line acquires a control signal corresponding to a mechanical signal inputted by a user, for example, to a force, a displacement or another type of mechanical input, and converts that mechanical signal into a corresponding electric/electronic or hydraulic control signal.

When this second electric or electronic transmission line or control circuit is provided, the mechanical signal is transduced into a corresponding electric/electronic control signal through a transducer system of the optical or electric type, typically a potentiometer. Consequently, the signal provided by the force and/or the displacement of the rudder, of the control lever or, more generally, of the control member is converted into a corresponding control signal for an actuator actuating the power-consuming unit.

Therefore, this electric/electronic circuit turns the control signal generated by the user on the control member into a corresponding electric/electronic signal actuating a load operating system, or directly controls the load or power-consuming unit, alternately or in combination.

In one example of the prior art, the system transducing mechanical control signals into a corresponding electric/electronic control is optical. An optical system acquires the displacement, that is, a mechanical signal, and turns it into a corresponding electric/electronic signal. With an optical sensor, proper detection of the control signal closely depends on the cleanliness of the sensor, because an improper cleaning may cause incorrect or wrong detection of the control signal, which is thus transmitted incorrectly or is not transmitted at all.

Marine environments are highly aggressive and might greatly affect cleanliness and proper operation of an optical device. Particularly, if the control apparatus is located on the watercraft deck or in an area of the watercraft that is particularly exposed to weather and environmental agents, oxidation and salt are likely to cause an early fouling of the optical control signal detection system.

In another example of the prior art, an electric system may be employed, in which the control member is operably connected to a potentiometer detecting the mechanical control and turning it into a corresponding electric control signal, which is transmitted to an actuator, to the power-consuming unit, or to a controller.

Potentiometers are particularly sensitive to oxidation in marine environments and prone to deterioration, which causes a malfunctioning of the potentiometer and hence a malfunctioning of the electric/electronic control circuit.

More particularly, the electric contacts of potentiometers are sensitive to oxidation and do not operate properly when oxidized. Furthermore, the conformation of potentiometers makes them not easily serviceable, causing a replacement of the potentiometer in the event of failure.

In addition, transducers have a physical configuration that makes access difficult, regardless of being of the optical, electrical or potentiometric type. The extensive maintenance required by prior art transducers, to maintain them in a clean and non oxidized state, is particularly cumbersome, time-consuming and costly.

SUMMARY OF THE INVENTION

It is an object of the present invention is to provide watercraft control apparatus that include a control member for operating a power-consuming unit or load that is simple to operate and relatively inexpensive. A control member according to the present invention is operably connected to the power-consuming unit or load through a drive member, which transmits a control force and/or a displacement from the control member to the power-consuming unit or load.

A watercraft control apparatus constructed according to the principles of the present invention includes at least one control member for operating at least one power-consuming unit or load. This control member is operably connected to the power-consuming unit or load through a drive member, which transmits a control force and/or a displacement from the control member to the power-consuming unit or load. A watercraft control apparatus according to the present invention further includes an actuator for actuating the power-consuming unit and one or more magnetic units for transducing the force and/or displacement of the control member into a corresponding electric/electronic signal, thereby causing the actuator to operate.

Briefly, an apparatus according to the present invention includes a first mechanical control signal transmission circuit or line, transmitting a mechanical signal such as a force and/or a displacement to the actuator, the power-consuming unit or to a similar unit. The mechanical signal is provided by an action of the user on the control member, for example, a rudder wheel or a lever, and may include a hydraulic signal or other type of mechanical signal. A second electric/electronic control line acquires control signals from the control member, for example, the force and/or displacement input by the operator or user and converts, or transduces, the mechanical signal into a corresponding electric/electronic signal through one or more magnetic units, causing operation of the actuator.

The magnetic units in the present invention provide significant advantages, particularly when compared with optical or electric systems, such as potentiometers, in the prior art.

More particularly, magnetic units are sensitive to oxidation but exhibit no malfunctioning when oxidized, opposite to the malfunctioning of prior art transducers. Typically, magnetic units include a magnet and a corresponding magnetic sensor, which detects the presence of the magnet. Any oxidation, as typically found on watercrafts or in marine environments, causes no such malfunctioning that affects proper operation of the apparatus, which maintains its proper operation even in an oxidized state.

Additionally, the magnetic units are not sensitive to fouling, for example by salt accumulating thereon, causing no significant alteration the magnetic field and no malfunctioning of the units.

In a first embodiment of the present invention, the control member is a steering wheel, a rudder wheel or the like and the power-consuming unit is at least a rudder or the like. In this embodiment, a user controls the watercraft by rotating the steering wheel or the rudder wheel, causing a corresponding actuation of the rudder blade or, more generally, of the rudder and/or rudder actuator.

Mechanical control is transmitted to the rudder and/or to a hydraulic pump that controls the rudder blade or the rudder through a first transmission line or circuit for mechanical control signals. In one embodiment, the rudder wheel or the steering wheel is connected to a mechanical device, such as drive cables, or a hydraulic device, for example a hydraulic pump, which is used to transmit the control signal or the user-set control to the power consuming unit as a displacement and/or force driving the power-consuming unit, here the rudder.

In addition to the first mechanical circuit, a second transmission circuit for control signals is provided, in which the control member, that is, the rudder wheel or the like, is operably connected to at least one magnetic unit that transduces mechanical control signals into corresponding magnetic control signals and, as a result, into electric/electronic control signals.

In a preferred embodiment, the magnetic unit includes at least one magnetic sensor and one magnet that are rotatably and integrally mounted to the steering or rudder wheel or, or, in general, to the control member. The magnet may be integral with the axle of the steering wheel or the control member, and the magnetic sensor may be stationary with respect to such axle.

One embodiment includes two, preferably three magnetic units, arranged at substantially 120° from each other about the axle of the steering wheel or rudder wheel or other control member.

Thus, an apparatus according to the present invention employs a magnetic unit composed of at least one magnet and one magnetic sensor to detect the control signal that the user imparts by rotating the steering wheel or the rudder wheel, and to transduce that control signal into a corresponding magnetic signal and successively into a corresponding electric signal, which is used to control an actuator, a hydraulic pump, a controller or directly the rudder.

In one embodiment of the present invention, the magnetic unit is operably connected to a data or signal transmitting/receiving controller, which in turn is operably connected to at least one actuator for actuating a load, such as the rudder, in response to the signal detected by the magnetic unit and transmitted by the magnetic unit to the controller and onwards to the actuator.

Based on the foregoing, an apparatus according to the present invention may be configured to operate in two modes: a mechanical mode (the term mechanical also including hydraulic), ad an electric/electronic mode, in which the signal is acquired by a magnetic unit. The two operating modes may be implemented alone or in combination, and particularly, during operation in the electric/electronic mode alone, if the mechanical circuit uses a hydraulic pump for operating the rudder, the hydraulic pump of the mechanical circuit may be short-circuited or by-passed.

An advantage of the above embodiment is that, in the event of failure of the electric/electronic circuit, operation can be switched to the mechanical (hydraulic) mode by opening the valves of the hydraulic pump of the mechanical circuit, so that no other operation is needed to operate the pump. This provides a failsafe operation by which, should the controller detect any malfunctioning of the electric/electronic control line, the pump of the mechanical circuit can simply be turned on to restore operation, with no risk that the user will lose control of the watercraft.

In another embodiment of the present invention, the control member is a control lever or a similar device and the power-consuming unit is a motor, or a hydraulic, electric, mechanical actuator, or a similar device. The power-consuming unit may further include another type of operator-controllable power-consuming unit on the watercraft, for example, a sail winch, a bow-thruster, a main or auxiliary engine, an anchor or other devices that are employed on board a watercraft.

When the control member is specifically a control lever or a similar device, the magnetic unit is operably connected to the lever or the similar device, and the magnetic unit includes at least one magnetic sensor and one magnet, the sensor and the magnet being rotatably and integrally mounted on the lever.

In one preferred embodiment, the magnet is integral with the lever or similar device, and the magnetic sensor is stationary with respect to the lever.

In another preferred embodiment, the apparatus has two, preferably three magnetic units, and when three magnetic units are provided, they are arranged at substantially 120° from each other around the fulcrum of the lever or the similar device. Thus, the three magnetic units, which operate as transducers, transduce the mechanical control signal, that is, the displacement of the lever, into a corresponding magnetic signal and the latter into a corresponding electric/electronic signal, which can be transmitted through the electric/electronic circuit directly to the power-consuming unit or to a data or signal transmitting/receiving controller, to which the magnetic units are operably connected. In this configuration, the controller is operably connected to at least one actuator for actuating a load or a power-consuming unit in response to a signal detected by the magnetic units and transmitted by the magnetic units to the controller and onward to the actuator.

The controller may also monitor the operating parameters of the apparatus, for example, by detecting any malfunctioning and by generating a warning or alarm signal and, alternatively to or in combination with the above, by inhibiting the electric/electronic line and restoring the mechanical or hydraulic line.

Among the above embodiments, a particularly preferred embodiment uses a controller operably connected to an actuator for actuating a load or power-consuming unit through an electric and/or electronic connection and/or a CAN bus or s similar system.

The solution with a CAN bus is advantageous because the CAN bus enables the interaction of multiple devices along the same communication line. Thus, incorporating a CAN bus provides for a simplified design. In this arrangement, the control apparatus may be mounted on board an existing watercraft by establishing the required electric/electronic connections, thereby providing a power-assisted control of the magnetic type within an existing transmission line for control signals.

In still another embodiment, an apparatus according to the present invention enables a progressive or scaled reading of control signals.

In the prior art, no scaling is provided for detected and transmitted control signals. Instead, an apparatus constructed according to the principles of the present invention provides, for example, a simple scaling of the signal. For example, the controller can record a displacement step, corresponding to a given control signal, for every two passes of the magnet relative to the magnetic sensor and not at every simple pass, causing rotation of the rudder wheel or of the steering wheel to be scaled and facilitating watercraft control in narrow passages or difficult conditions, for example during docking. When this configuration is employed, the so-called scaled drive may be enabled and disabled as desired using a special control.

BRIEF DESCRIPTION OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

FIGS. 4 and 4*a* are respectively a top view and a cross-sectional view of magnetic sensors in an embodiment of the invention.

DETAILED DESCRIPTION OF EMBODIMENTS OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1:
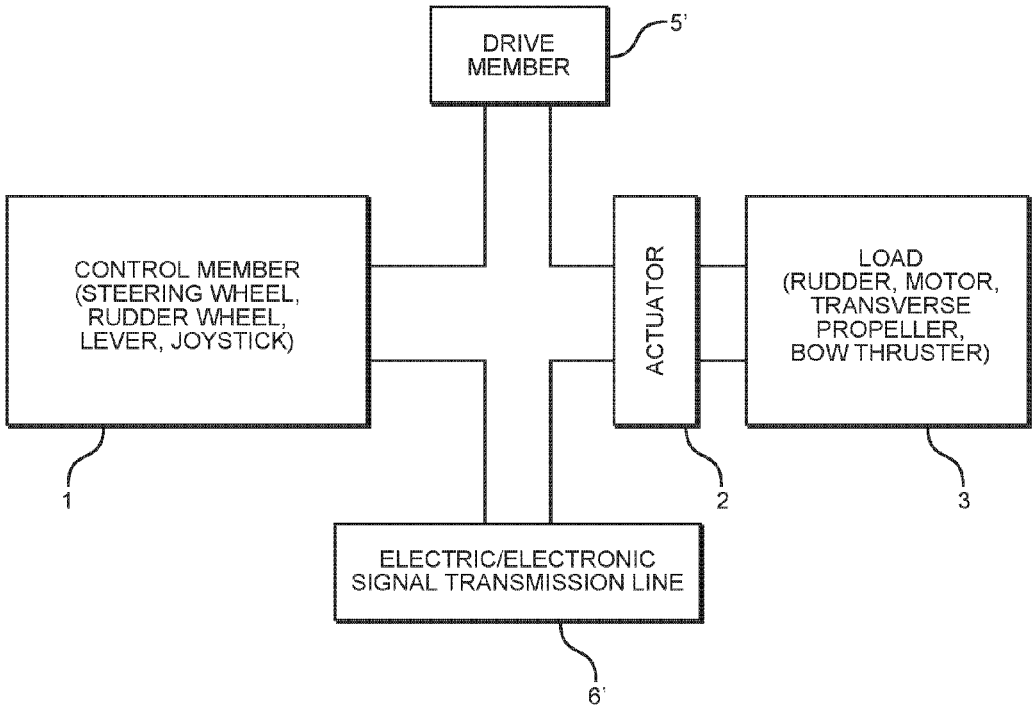
FIGS. 1 and 1*a* are schematic illustrations of embodiments of the invention.
Figure 1A:
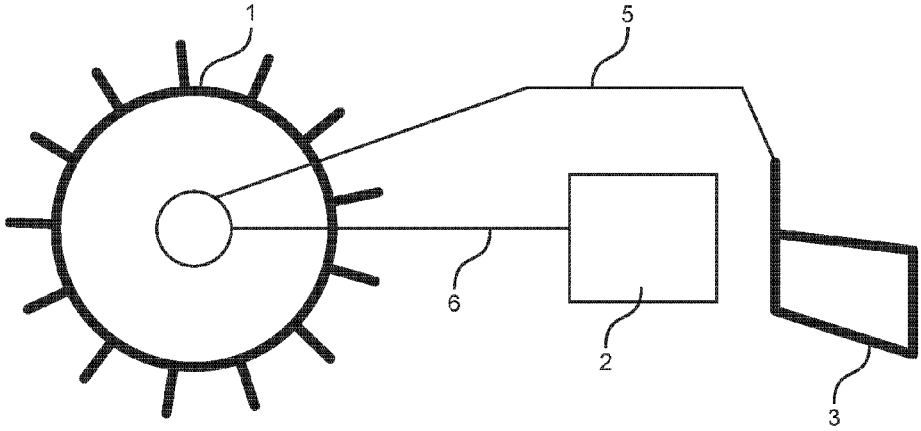

FIG. 1 and, more particularly, FIG. 1A illustrate a first embodiment of the present invention, in which a watercraft control apparatus includes at least one control member 1, in the example of FIG. 1A a rudder wheel, for operating at least one power-consuming unit or load 3, in this example the rudder. Control member 1 is operably connected to power-consuming unit or load 3 through a drive member 5' that transmits a control force and/or displacement from control member 1 to power-consuming unit or load 3. The control apparatus further includes an actuator 2 for actuating power-consuming unit 3 and one or more magnetic units for transducing the force and/or the displacement of control member 1 into a corresponding electric/electronic signal for correspondingly operating actuator 2. The electric/electronic control signal acquired by the magnetic units for transducing the force and/or the displacement of control member 1 into a corresponding electric/electronic signal is transmitted to actuator 2 through an electric/electronic signal transmission line 6'.

In this first embodiment, a user operates rudder wheel 1 and obtains a corresponding effect on rudder 3 by means of the alternate or combined action of the force and/or displacement transmitted along mechanical circuit 5 and the power-assisted control provided by actuator 2, which is controlled by the electric/electronic signals transmitted along electric/electronic circuit 6.

Figure 2:
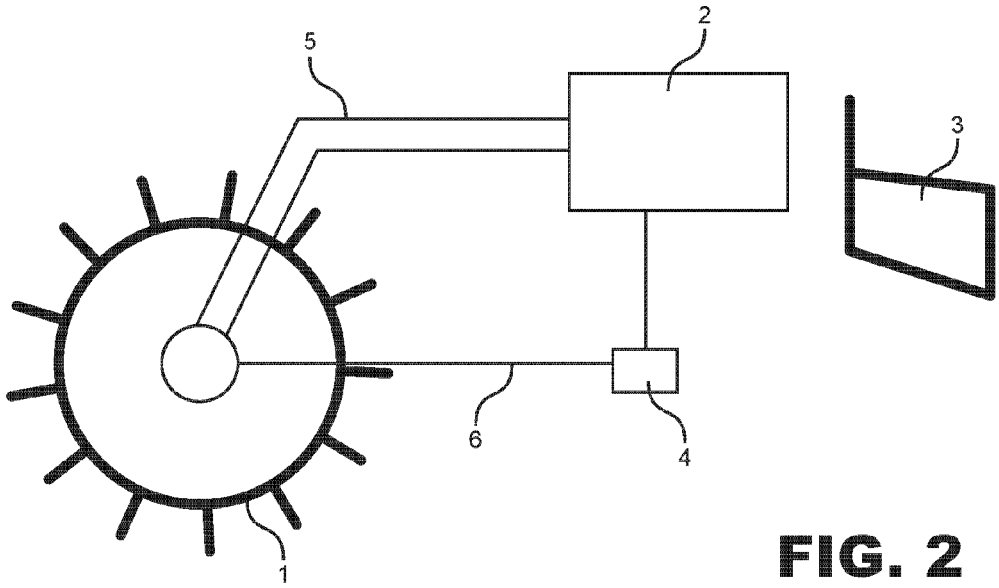
FIG. 2 is a schematic illustration of another embodiment of the invention.

In a second embodiment, illustrated in FIG. 2, a control member 1 is provided for controlling a power-consuming unit 3 through an actuator 2. Here, mechanical control signals, which in one embodiment may consist of or include hydraulic control signals, are directly transmitted to actuator 2 through mechanical circuit 5 and through electric/electronic circuit 6 that transmits the signals, for example, to a controller 4 controlling actuator 2. Unlike the configuration of FIG. 1, power consuming unit 3 is controlled or managed by actuator 2 only, and actuator 2 is in turn controlled alternately or in combination by mechanical signals, such as force and/or displacement, and by electric/electronic signals acquired from control member 1 through magnetic sensors.

FIGS. 4 and 4*a* show an embodiment with magnetic sensors disposed on the axle of the wheel rudder. Here, control member 1 is a steering wheel, a rudder wheel or the like and the power-consuming unit is at least a rudder or the like. Magnetic units 90 are operably connected to the steering wheel or the like and include at least one magnet 91 and one magnetic sensor 92. Magnet 91 or sensor 92 are rotatably and integrally mounted on the steering wheel or the like. More particularly, FIG. 4*a* illustrates an embodiment, in which magnet 91 is integral with axle 80 of the steering wheel or the like and magnetic sensor 92 is stationary with respect to axle 80. This configuration may be obtained by fitting magnet 91 onto a wheel that is rotatably integral with axle 80 and by fitting magnetic sensor 92 into the wheel box of the rudder wheel.

In one embodiment, the apparatus has two, preferably three magnetic units 90 which, as shown in FIG. 4, may be arranged at substantially 120° from each other about the axle of the steering wheel, rudder wheel or the like.

Figure 6:
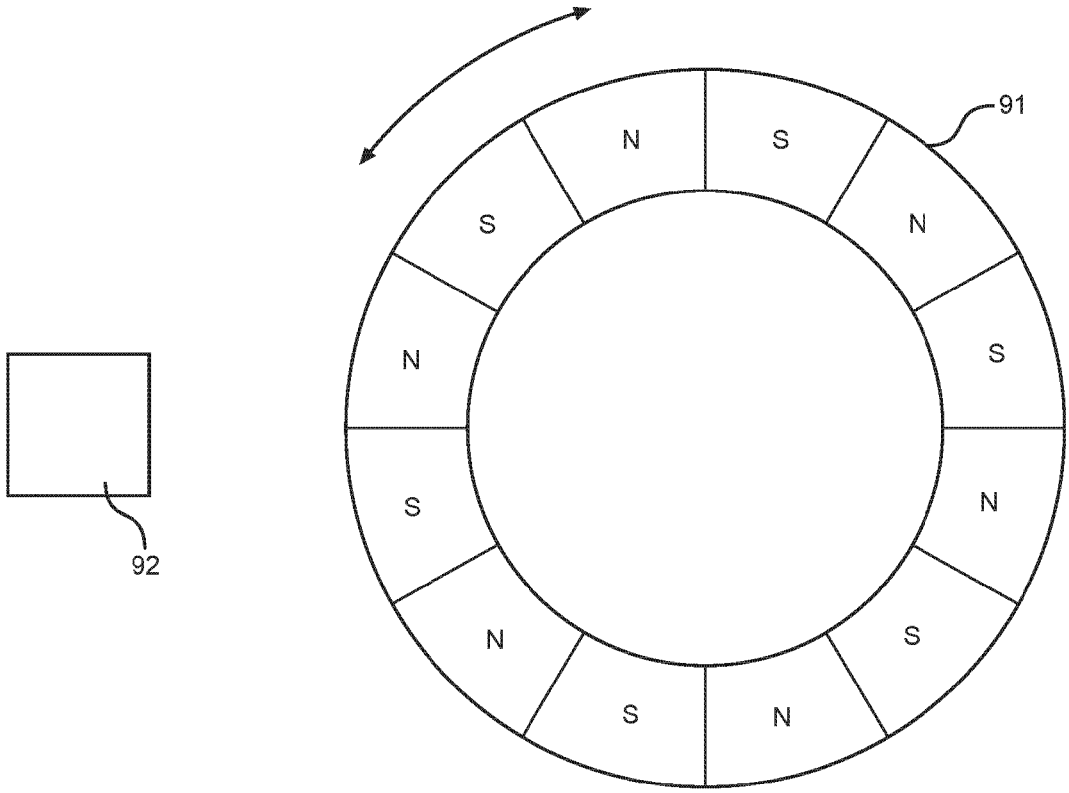
FIG. 6 is a schematic illustration of a wheel-shaped apparatus in an embodiment of the invention.

In an alternative embodiment, illustrated in FIG. 6, the magnetic units are arranged in the manner of a magnetic wheel rotatably integral with the steering wheel, and are adapted to detect the rotation of the steering wheel. Here, magnets 91 have alternating North/South polarities and sensor 92 detects the rotation of the steering wheel and possibly the rotation speed thereof upon the passage of magnets 91 having North/South polarities.

Figure 3:
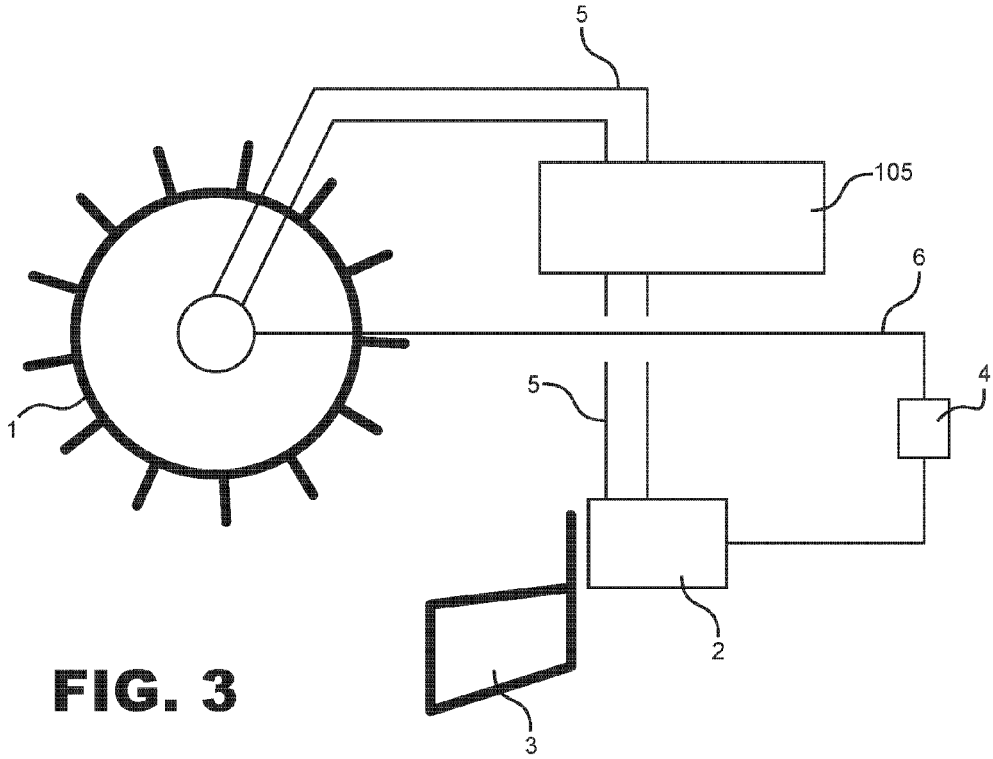
FIG. 3 is a schematic illustration of still another embodiment of the invention.

Magnetic units 90 may be operably connected to a controller 4 that transmits and receives data or signals and that controls actuator 2, which controls power-consuming unit 3, as shown in FIG. 3.

Controller 4 is operably connected to at least one actuator 2 that actuates load 3, for example, a rudder. Load 3 is actuated in response to a signal detected by the magnetic unit and transmitted by the magnetic unit to controller 4, and by controller 4 to actuator 2. As shown in FIG. 3, steering wheel 1 further is coupled to a mechanical control circuit, a hydraulic control circuit or the like 5, which is operably connected directly to load 3, for example a rudder, and/or to actuator 2 for actuating load 3, alternatively or in combination.

Controller 4 is operably connected to the at least one actuator 2 for actuating a load 3 through an electric and/or electronic connection and/or by a CAN bus or the like. At the same time, controller 4 may also be operably connected to mechanical, hydraulic control circuit or the like 5.

Basically, the control apparatus includes one or more magnetic units 90 transducing a mechanical control signal into a corresponding electric/electronic control signal to operate the actuator 2 and also an electronic control circuit 6, configured as discussed above and operably actuated alternatively to, or in combination with, the hydraulic control circuit or like system.

In one embodiment, actuator 2 having electric/electronic control circuit 6 operably connected thereto is a hydraulic pump operably connected to the axle of rudder 3. Hydraulic control circuit or the like 5 is operatively connected to pump 2, which also has an electronic control circuit connected thereto.

In an electronic operating mode, when the control signal generated by the input system of the control signal is transmitted through electronic control circuit 6 by means of the magnetic units, hydraulic control circuit or the like 5 may be disabled, for example through the use of a bypass.

An additional pump 105 may be also provided, to be coupled to mechanical circuit 5 for controlling actuator 2.

Figure 5:
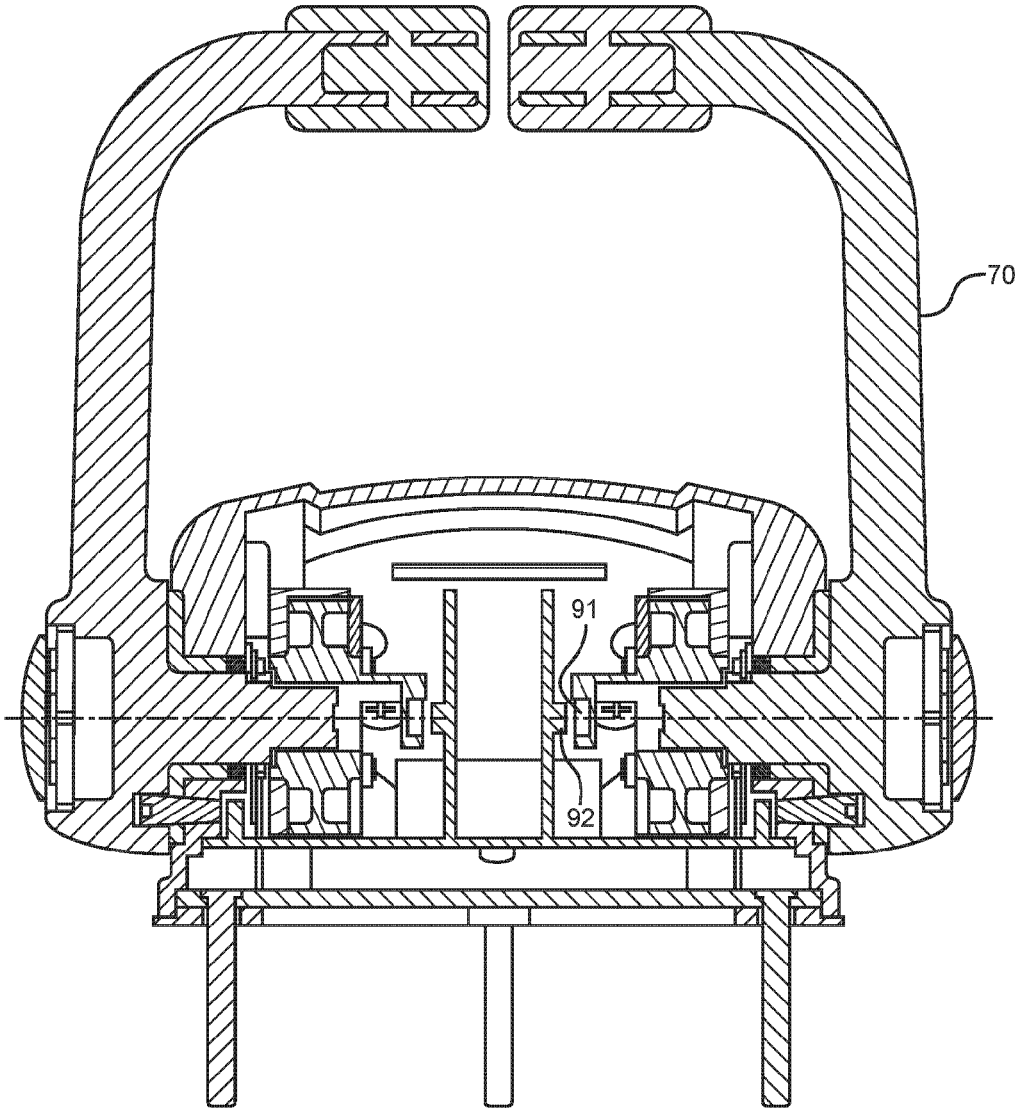
FIG. 5 is a cross-sectional view a magnetic sensor in another embodiment of the invention.

Control member 1 may be alternatively provided in the form of a control lever or a similar device, and the power-consuming unit or actuator 2 may include at least one motor, one hydraulic, electric, mechanical actuator, or a similar device. FIG. 5 illustrates a control member in the form of a control lever 70, which has at least one magnetic unit 90 operably connected to control lever 70 or to a similar device.

Magnetic unit 90 includes at least one magnetic sensor 92 and one magnet 91, which are rotatably and integrally mounted to lever to or to a similar device. Preferably, magnet 91 is integral with lever 70 or a similar device, while magnetic sensor 92 is stationary with respect to lever 70.

The apparatus of this embodiment has two, preferably three magnetic units 90, arranged at substantially 120° from each other around the fulcrum of lever 70 or a similar device, and is operably connected with a data or signal transmitting/receiving controller 4.

Also preferably, controller 4 is operably connected to the at least one actuator 2 actuating a load or a power-consuming unit 3 in response to a signal detected by magnetic unit 90 and transmitted by magnetic unit 90 to controller 4 and by controller 4 to the actuator 2.

Lever 70 may be configured to further include a mechanical, for example, a hydraulic control circuit or a similar system 5, which is operably connected directly to load or power-consuming unit 3 and/or to actuator 2 for load 3, alternatively or in combination.

Preferably, controller 4 is operably connected to the at least one actuator 2 for actuating a load or power-consuming unit 3 through an electric and/or electronic connection and/or through a CAN bus or a similar system.

The control apparatus having the one or more magnetic units for transducing the mechanical control signal into a corresponding electric/electronic control signal that operates actuator 2 forms electronic control circuit 6, which is operably actuated alternatively to or in combination with mechanical or hydraulic control circuit 5 or a similar system.

Actuator 2 having electronic control circuit 6 connected thereto includes, as a non-limiting example, a hydraulic pump operably connected to the axle of the lever or to a similar component, and mechanical, hydraulic or similar circuit 5 is also operably connected to the pump connected to electronic control circuit 6.

An electronic operating mode may be advantageously provided, for example, when the inputted control signal is transmitted through electronic control circuit 6 by means of the magnetic unit, and hydraulic control circuit 5 or the like is disabled, that is, bypassed.

In another embodiment, an apparatus according to the present invention may be used in combination with a power-consuming unit that controls rotation of the steering wheel, whereby the latter may be placed in a more comfortable and safer location for a watercraft operator or driver.

In the same manner as disclosed above, in one embodiment control member 1 is the axle of a steering wheel, a wheel rotation adjustment lever, or a similar device adjusting the tilt of the steering wheel to a more comfortable and more convenient position for a user, and the at least one power-consuming unit is at least one motor, one hydraulic, electric, or mechanical actuator or a device for rotary actuation of the steering wheel. The user may adjust the rotation of the steering wheel to a substantial degree by tilting it as desired.

The at least one magnetic unit may be operably connected to the steering column or to a similar component, and the magnetic unit comprises at least one magnetic sensor and one magnet, the sensor or the magnet being integral with the steering wheel axle or the similar component or, alternatively to or in combination with the above, the user may adjust the steering wheel tilt using a special control lever that includes at least one magnetic sensor and one magnet according to the present invention, in the same manner as disclosed above.

It shall be noted that, both in this embodiment and in above described embodiments, the provision of a single magnet at the axle of the control member, that is, a lever, a steering wheel or the like causes such single magnet to be preferably a permanent magnet, that is a magnet having two North and South magnetic polarities, to enable a detector to detect the rotation of the two polarities caused by the rotation of the control member.

An apparatus constructed according to the principles of the present invention detects the signal corresponding to the steering axle rotating/tilting control, which responds to the rotation of the axle of the steering wheel, the control lever or a similar component. Preferably, the magnet is integral with the steering axle or the like, and the magnetic sensor is stationary with respect to the steering axle.

In the same manner as previously disclosed with regard to the rudder, the magnetic unit is operably connected to a data or signal transmitting/receiving controller, which in turn is operably connected to at least one actuator for actuating a load or power-consuming unit, particularly for rotating the steering wheel. The load is actuated in response to the signal detected by the magnetic unit and transmitted by the magnetic unit to the controller, and by the controller to the actuator, providing for the steering axle to be rotated/tilted as desired, and set and located in a comfortable desired position.

In one embodiment, the controller is operably connected to the at least one actuator for actuating a load or power-consuming unit through an electric and/or electronic connection and/or a CAN bus or a similar device, and the control apparatus, which has one or more magnetic units for transducing the mechanical control signal into a corresponding electric/electronic control signal to operate the actuator, forms an electronic control circuit operably actuated in alternative to, or in combination, with the hydraulic or otherwise mechanical control circuit.

The load may be thus controlled either in power mode or in non power mode, in the same manner as described above with regard to the rudder.

In this embodiment, the actuator having the electronic control circuit connected thereto includes a hydraulic pump, operably and rotatably connected to the steering axle or to a similar device, and the hydraulic or otherwise mechanical circuit is operably connected to the pump, which has the electronic control circuit connected thereto.

In the electronic operating mode, that is, when the control signal is transmitted through the electronic control circuit by means of the magnetic unit, the hydraulic or otherwise mechanical control circuit is in a disabled state, that is, is bypassed.

Another embodiment of the present invention relates to a watercraft maneuvering system that has all control members (such as levers, steering wheels, joysticks or the like) for operating at least one power-consuming unit or load (such as rudders, engines, transverse propellers, or the like) operably connected to the respective power-consuming units or loads through corresponding drive members that transmit a control force and/or a displacement from the control members to their respective power-consuming units or loads. The apparatus according to this embodiment includes an actuator for actuating the respective power-consuming unit and further includes one or more magnetic units for transducing the force and/or the displacement of the control member into a corresponding electric/electronic signal for a corresponding operation of the actuator. The electric/electronic signal is transmitted through a connection of the CAN bus type.

In a preferred embodiment, actuator 2, which is operably connected to electric/electronic control circuit 6, is a hydraulic pump in turn operably connected to the axle of rudder 1. Hydraulic or otherwise mechanical control circuit 5 is operatively connected to the pump, which is also connected to electronic control circuit 6.

In the electronic operating mode, that is, when the control signal is transmitted through the electronic control circuit 6 by means of the magnetic unit, hydraulic or otherwise mechanical control circuit 5 may be disabled, that is, may be bypassed.

In still another embodiment, control member 1 for operating at least one power-consuming unit or load 3 may be a joystick, for example, for controlling a transverse propeller. The joystick is operably connected to power-consuming unit or load 3 through a drive member that transmits a control force and/or a displacement from control member 1 to power-consuming unit or load 3. The control apparatus according to this embodiment also includes actuator 2 for actuating power-consuming unit 3, that is, the transverse propeller, and also includes one or more magnetic units for transducing the force and/or the displacement of control member 1 into a corresponding electric/electronic signal for a corresponding operation of actuator 2.

The remaining constructive features of the joystick system are similar to those previously described above with regard to control members 1.

Therefore, an apparatus according to the present invention may provide an electronic control line in combination with, or as an alternative to, a mechanical control line, as disclosed above. Accordingly, an electronic control line may be provided that transduces and transmits control signals to power-consuming units, or an electronic control line that operates alternatively to, or in combination with, a mechanical control line.

Similarly, the control member may include one or more tilting control levers for outboard engines. Engine tilting consists in extracting the engines at least partly out of the water by rotating them about a substantially horizontal axis, typically at a point that substantially corresponds to the junction between the engine and the transom by motion being known as engine TILT.

In one embodiment, a lever may be used for a power-assisted control of engine TILT. A lever may be rotated for each engine, thereby controlling the rotation or TILT of the engine. The engine TILT control lever may be formed like the lever shown in FIG. 5, with a magnet disposed in a substantially coincident position with respect to the axle of the lever.

According to another embodiment, an apparatus according to the present invention detects both the displacement of the control member and the speed of such displacement, so that the action on the power-consuming unit may be proportional to such displacement speed, providing for a so-called incremental control that accounts for the speed of the user's control.

For example, if two parallel lines are provided, that is, a mechanical and an electronic control lines as disclosed above, whenever the controller detects a speed above a certain preset or presettable speed threshold, control may be transmitted along the mechanical line, the electronic line, or in combination along both lines according to such speed.

While the invention has been described in connection with the above described embodiments, it is not intended to limit the scope of the invention to the particular forms set forth, but on the contrary, it is intended to cover such alternatives, modifications, and equivalents as may be included within the scope of the invention.

What is claimed is:

1. A watercraft control apparatus comprising:

a control member operating a load, wherein the control member is a control lever and the load is a motor;

a mechanical circuit for transmitting a displacement from the control member to the load;

an electronic control circuit comprising one or more magnetic units transducing the displacement of the control member into an electric or electronic signal to the load, wherein the magnetic units are operably connected to the control lever, wherein the magnetic units include at least a magnetic sensor and a magnet, and wherein one of the magnetic sensor or the magnet is rotatably mounted to the control lever;

an actuator actuating the load, the actuator being operably interposed between the load and each of the mechanical circuit and the electronic control circuit; and an auxiliary pump operably interposed between the mechanical circuit and the actuator, the auxiliary pump controlling the actuator, wherein the mechanical circuit and the one or more magnetic units operate the load.

2. The apparatus of claim 1, wherein the control member includes an axle, wherein the magnet is integrally coupled with the axle, and wherein the magnetic sensor is stationary with respect to the axle.

3. The apparatus of claim 1, wherein the one or more magnetic units include least two magnetic units.

4. The apparatus of claim 1, wherein the mechanical circuit is a hydraulic circuit.

5. The apparatus of claim 1, wherein the one or more magnetic units are operably connected to a controller transmitting and receiving data or a signal.

6. The apparatus of claim 5, wherein the controller is operably connected to the actuator, and wherein the load is actuated in response to the signal transmitted by the magnetic units to the controller and further transmitted by the controller to the actuator.

7. The apparatus of claim 5, wherein the controller is operably connected to the actuator by at least one of an electric connection, an electronic connection, or a CAN bus, and wherein the controller is operably connected to the mechanical circuit alternatively to or in combination with the electric connection, electronic connection, or the CAN bus.

8. The apparatus of claim 1, wherein the mechanical circuit is a hydraulic circuit that is operatively connected to the auxiliary pump.

9. The apparatus of claim 8, wherein the hydraulic circuit is disabled when the actuator is operated by the electronic circuit.

10. The apparatus of claim 1, wherein the magnet is integral with the lever, and wherein the magnetic sensor is stationary with respect to the lever.

11. The apparatus of claim 10, wherein there are a plurality of magnetic sensors and magnets.

12. The apparatus of claim 10, wherein the magnetic sensor is located on an axle of the lever.

13. The apparatus of claim 1, wherein the magnetic units are operably connected to a data or signal transmitting and receiving controller.

14. The apparatus of claim 13, wherein the controller is operably connected to the actuator, and wherein that load is actuated in response to a signal detected by the magnetic units and transmitted by the magnetic units to the controller and further transmitted by the controller to the actuator.

15. The apparatus of claim 13, wherein the mechanical circuit is a hydraulic circuit operably connected to the load and to the actuator.

16. The apparatus of claim 13, wherein the controller is operably connected to the actuator by an electric connection, an electronic connection, or a CAN bus.

17. The apparatus of claim 1, wherein the magnetic units each have a north/south polarity, and wherein the magnetic units are disposed on the control member, so that a displacement of the control member is detected by a sensor by detecting a passage of the north/south polarities.

18. The apparatus of claim 17, wherein the sensor further measures a rate of displacement of the control member by measuring a rate of displacement of the north/south polarities.

19. A watercraft control apparatus comprising:

a control member operating a load;

a mechanical circuit for transmitting a displacement from the control member to the load;

an electronic control circuit comprising one or more magnetic units transducing the displacement of the control member into an electric or electronic signal to the load;

an actuator actuating the load, the actuator being operably interposed between the load and each of the mechanical circuit and the electronic control circuit; and an auxiliary pump operably interposed between the mechanical circuit and the actuator, the auxiliary pump controlling the actuator, wherein the mechanical circuit and the one or more magnetic units operate the load, and wherein the one or more magnetic units include three magnetic units disposed substantially at 120° from each other.

20. The apparatus of claim 19, wherein the control member comprises an axle of a steering wheel, and wherein the load is at least a motor.

21. The apparatus of claim 20, wherein the magnetic units are operably connected to the axle, wherein the magnetic units comprise a magnetic sensor and a magnet, and wherein the sensor or the magnet are rotatably mounted on the axle.

22. The apparatus of claim 21, wherein the magnet is integral with the axle, and wherein the magnetic sensor is stationary with respect to the axle.

23. The apparatus of claim 21, wherein the magnetic units are operably connected with a data or signal transmitting and receiving controller.

24. The apparatus of claim 23, wherein the controller is operably connected to the actuator, and wherein the load is actuated in response to a signal detected by the magnetic units and transmitted by the magnetic units to the controller and further transmitted by the controller to the actuator.

25. The apparatus of claim 23, wherein the mechanical circuit is a hydraulic circuit operably connected to the load and to the actuator, alternatively to or in combination with magnetic units transducing one or more of a force or the displacement of the control member.

26. The apparatus of claim 23, wherein the controller is operably connected to the actuator by an electric connection, an electronic connection, or a CAN bus.

27. The apparatus of claim 23, wherein the magnetic units are included in an electronic control circuit acting alternatively to or in combination with the mechanical circuit.

28. The apparatus of claim 27, wherein the mechanical control circuit is disabled when the actuator is controlled by the electronic control circuit.

29. The apparatus of claim 19, wherein the control member is a joystick and the load is a transverse propeller or bow thruster.

30. The apparatus of claim 29, wherein the magnetic units are operably connected to a data or signal transmitting and receiving controller, and wherein each of the magnetic units comprises a magnetic sensor and a magnet, the magnetic sensor and magnet being displaceable one in relation to the other.

31. The apparatus of claim 30, wherein the apparatus is configured for scaling up or down a signal transmitted from the magnetic units to the controller.

32. The apparatus of claim 30, wherein the controller records one or more of a motion, a displacement, or a force step corresponding to a given signal for every two or more passes of magnet displacements of the magnetic sensor in relation to the magnet, thereby enabling a scaled drive.

33. The apparatus of claim 32, wherein the scaled drive can be enabled and disabled as desired.

34. The apparatus of claim 30, wherein the magnetic units detect a rate of displacement of the control member, and wherein a rate of actuation of the load is proportional to the rate of displacement of the control member, thereby providing for an incremental control of the load.

35. The apparatus of claim 30, wherein the controller is configured to detect a rate of displacement of the control member and to decide whether to operate the load through either of both the mechanical circuit and the electric or electronic signal according to the rate of displacement of the control member.

36. A watercraft maneuvering system comprising:

a control member for operating a load, wherein the control member is a control lever and the load is a motor;

a mechanical circuit for transmitting a displacement from the control member to the load; and an electronic control circuit comprising one or more magnetic units transducing the displacement of the control member into an electric or electronic signal to the load, wherein the magnetic units are operably connected to the control lever, wherein the magnetic units include at least a magnetic sensor and a magnet, and wherein one of the magnetic sensor or the magnet is rotatably mounted to the control lever;

an actuator actuating the load, the actuator being operably interposed between the load and each of the mechanical circuit and the electronic control circuit; and an auxiliary pump coupled to the mechanical circuit and controlling the actuator, wherein the electric or electronic signal is transmitted through a CAN bus connection connected to different components of the system.

37. The maneuvering system of claim 36, wherein the one or more magnetic units are three magnetic units disposed substantially at 120° from each other.

* * * * *